US007954676B2

(12) United States Patent
Petit

(10) Patent No.: US 7,954,676 B2
(45) Date of Patent: Jun. 7, 2011

(54) DISPENSING HEAD AND FLUID PRODUCT DISPENSER COMPRISING SAME

(75) Inventor: Ludovic Petit, Vitot (FR)

(73) Assignee: Valois SAS, Le Neubourg (FR)

( * ) Notice: Subject to any disclaimer, the term of this patent is extended or adjusted under 35 U.S.C. 154(b) by 563 days.

(21) Appl. No.: 10/495,531

(22) PCT Filed: Nov. 13, 2002

(86) PCT No.: PCT/FR02/03871

§ 371 (c)(1),
(2), (4) Date: Nov. 8, 2004

(87) PCT Pub. No.: WO03/041865

PCT Pub. Date: May 22, 2003

(65) Prior Publication Data

US 2005/0072861 A1 Apr. 7, 2005

(30) Foreign Application Priority Data

Nov. 14, 2001 (FR) ..... 01 14722

(51) Int. Cl.
*B65B 1/30* (2006.01)

(52) U.S. Cl. ..... 222/321.9; 222/321.6

(58) Field of Classification Search .... 222/321.6–321.9, 222/321.2, 383.1, 380, 385, 321.3; 239/463, 239/464, 468, 469, 472, 473, 491–494, 533.1, 239/399

See application file for complete search history.

(56) References Cited

U.S. PATENT DOCUMENTS

| | | | | |
|---|---|---|---|---|
| 4,640,443 | A * | 2/1987 | Corsette | 222/321.3 |
| 5,348,189 | A * | 9/1994 | Cater | 222/1 |
| 5,664,706 | A * | 9/1997 | Cater | 222/321.2 |
| 5,806,762 | A | 9/1998 | Herr et al. | |
| 5,950,879 | A * | 9/1999 | Ritsche | 222/321.2 |
| 6,209,760 | B1 * | 4/2001 | Fuchs | 222/321.6 |
| 6,443,370 | B1 * | 9/2002 | Brulle et al. | 239/333 |
| 6,698,623 | B2 * | 3/2004 | Petit | 222/153.12 |
| 6,742,677 | B2 * | 6/2004 | Petit et al. | 222/321.7 |
| 6,830,163 | B2 * | 12/2004 | Petit | 222/321.7 |
| 6,918,514 | B2 * | 7/2005 | Petit | 222/321.9 |
| 6,929,156 | B2 * | 8/2005 | Petit et al. | 222/321.9 |
| 6,938,802 | B2 * | 9/2005 | Petit | 222/321.7 |
| 7,172,097 | B2 * | 2/2007 | Petit | 222/189.09 |
| 2002/0134863 | A1 * | 9/2002 | Arghyris | 239/491 |

FOREIGN PATENT DOCUMENTS

| | | |
|---|---|---|
| EP | 1 537 436 A | 12/1978 |
| EP | 0 867 228 A | 9/1998 |
| GB | K17793 A | 4/1911 |

* cited by examiner

*Primary Examiner* — J. Casimer Jacyna

(74) *Attorney, Agent, or Firm* — Sughrue Mion, PLLC

(57) ABSTRACT

A fluid dispenser device including a dispenser head, a piston and an outlet valve. The dispenser head has a body defining a fluid expulsion channel terminated by a dispenser orifice, a rigid insert disposed in the channel, and a shutter element disposed in the channel and displaceable between a closed position and an open position. The shutter element is urged at rest towards its closed position and automatically displaced towards its open position while fluid is dispensed, returning automatically to its closed position. The shutter element forms a single piece with the rigid insert. The rigid insert forms or is secured to the outlet valve and is mechanically displaceable towards its actuated position while the fluid is being expelled, and being automatically returned to its rest position once the fluid has been expelled.

12 Claims, 2 Drawing Sheets

DISPENSING HEAD AND FLUID PRODUCT DISPENSER COMPRISING SAME

FIELD OF INVENTION

The present invention relates to a dispenser head for a fluid dispenser, and more particularly to a dispenser head incorporating a shutter for closing the dispenser orifice. The present invention also relates to a fluid dispenser including such a dispenser head.

BACKGROUND

Shutters for fluid dispenser orifices are well known in the prior art. Several types exist. A first shutter family comprises those which are urged resiliently to their closed position, and which are deformed or displaced by the pressure of the fluid during dispensing, so as to open the dispenser orifice. Such devices can either include shutters made of deformable material, or shutters made in the form of a piston sliding in the expulsion channel away from the dispenser orifice, under the effect of the pressure exerted by the fluid. Document U.S. Pat. No. 5,806,762 discloses a deformable shutter surrounding a rigid insert, said shutter having a closure function that is directly linked to the pressure exerted by the fluid within the device. Another shutter family comprises shutters that are mechanically deformed by a portion of the dispenser head while the device is being actuated so as to dispense a measured quantity or "dose" of fluid. In that case the shutter is opened independently of the pressure exerted by the fluid. Document EP 0 867 228 describes an outlet valve presenting neither an insert nor a shutter at the expulsion duct of the dispenser head downstream from said valve.

Although they function correctly, such shutters present the drawback of being relatively complicated to manufacture and to assemble, and they are therefore expensive. In general, the dispenser head needs to be modified to enable the shutter to be fitted thereto, thereby also implying an increase in the manufacturing cost of the fluid dispenser device. In addition, when the dispenser head incorporates a spray profile, the presence of the shutter generally spoils the shape of said spray profile, which is prejudicial to the quality of the spray while the fluid is being expelled.

Document GB-17793 discloses a screwable insert for modifying the volume of a swirl chamber. The insert can serve as a shutter, but the user must manually displace said insert into and out of its closed position by screwing.

CERTAIN OBJECTS OF INVENTION

An object of the present invention is to provide a fluid dispenser head which does not present the above mentioned drawbacks.

Another object of the present invention is to provide a dispenser head which is simple to manufacture and to assemble, and which does not need to be modified.

Another object of the present invention is to provide a fluid dispenser head in which the shape of the spray profile at the dispenser orifice is not modified during expulsion of the fluid, thereby guaranteeing a spray of optimum quality.

Another object of the present invention is to provide a fluid dispenser including such a dispenser head.

The present invention therefore provides a dispenser head for a fluid dispenser, the head comprising a body defining a fluid expulsion channel terminated by a dispenser orifice, a rigid insert being disposed in said expulsion channel, said dispenser head further comprising a shutter element disposed in said expulsion channel, said shutter element being displaceable between a closed position of the expulsion channel and an open position of the expulsion channel, said shutter element being urged at rest towards its closed position, being automatically displaced towards its open position while the fluid is being dispensed, and returning automatically to its closed position once the fluid has been dispensed, said shutter element being formed integrally as a single piece with said rigid insert, so that said rigid insert is displaceable in said expulsion channel between a rest position, corresponding to the closed position of the shutter element, and an actuated position, corresponding to the open position of the shutter element.

Said shutter element is advantageously formed by the downstream end of said rigid insert in the flow direction of the fluid.

A hollow sleeve is advantageously statically disposed in said expulsion channel, said downstream end of said rigid insert sliding, preferably in sealed manner, in said sleeve, and a passage for the fluid being provided between the outside wall of said sleeve and the inside wall of the expulsion channel.

In the rest position of said rigid insert, the downstream end of said rigid insert advantageously extends beyond said fixed hollow sleeve and co-operates in sealed manner with said dispenser orifice.

A spray profile is advantageously defined between the front wall of the expulsion channel and said fixed hollow sleeve.

The present invention also provides a fluid dispenser device including a dispenser head as defined above.

The device is advantageously provided with a pump including a piston for dispensing the fluid, and an outlet valve, said rigid insert forming, or being secured to, said outlet valve of said pump, said rigid insert being displaced towards its actuated position while the fluid is being expelled, and being automatically returned to its rest position once the fluid has been expelled.

Said pump advantageously includes a hollow rod defining said expulsion channel, said hollow rod incorporating firstly the dispenser orifice, and secondly the piston of the pump.

Other advantages and characteristics of the invention appear more clearly from the following detailed description, made with reference to the accompanying drawings, and given by way of non-limiting examples, in which:

DETAILED DESCRIPTION OF EXEMPLARY EMBODIMENTS

Figure 1:
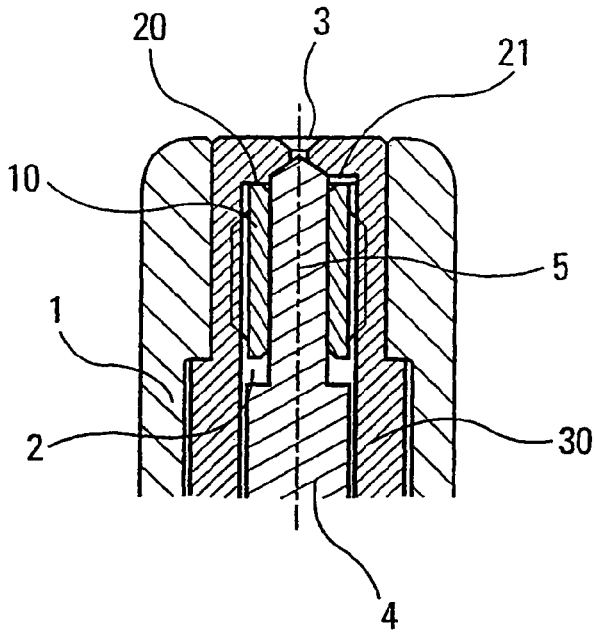
FIG. 1 is a diagrammatic cross-section view of a portion of a dispenser head constituting an advantageous embodiment of the invention, and shown in the closed position.
Figure 2:
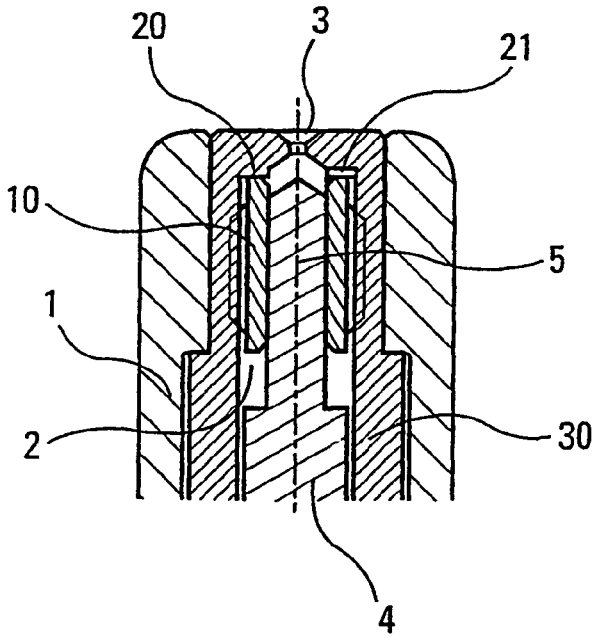
FIG. 2 is a view similar to the view in FIG. 1, but shown in the dispensing position.

The present invention relates to a dispenser head provided with a shutter. FIGS. 1 and 2 show the end portion of a nasal dispenser-head, but the present invention can also be adapted very well to other types of dispenser head.

With reference to FIGS. 1 and 2, the dispenser head comprises a body 1 defining an expulsion channel 2 which is terminated by a dispenser orifice 3. A rigid insert 4 is disposed in the expulsion channel 2 enabling the dead volume of the expulsion channel to be limited, and thereby enabling a narrow passage to be defined for the fluid, making it easier to spray said fluid through the dispenser orifice. The dispenser head advantageously includes a spray profile 21, preferably provided at the front end wall 20 of the expulsion channel 2, the dispenser orifice 3 thus being situated at the center of said spray profile 21. Preferably, and in known manner, the spray profile can include swirl channels which are connected to a swirl chamber that is disposed directly upstream from the dispenser orifice 3.

In the invention, the rigid insert 4 is disposed in movable manner in the expulsion channel 2, between a rest position shown in FIG. 1 and an actuated position shown in FIG. 2. A portion of said rigid insert, preferably its downstream end 5 in the flow direction of the fluid, forms a shutter element for closing the dispenser orifice. The shutter element is therefore displaced together with said insert 4 between a closed position (FIG. 1) corresponding to the rest position of the insert 4, and an open position (FIG. 2) corresponding to the actuated position of the insert 4. The shutter-forming insert 4 is urged towards its closed position, and, while the fluid is being dispensed, is automatically displaced towards its open position, before automatically returning once again to its initial position, i.e. its closed position.

Preferably, a hollow element, such as a hollow sleeve 10, is fixed in the expulsion channel 2, in the vicinity of the front wall 20 of said expulsion channel 2. Advantageously, the spray profile 21 can be provided between said fixed sleeve 10 and said front wall 20, in one or other of said elements, or even simultaneously in both if desired. The downstream end 5 of the rigid insert 4 slides, preferably in sealed manner, inside said fixed hollow sleeve 10, whereas the fluid flows outside said sleeve 10, between its outside wall and the inside wall of the expulsion channel 2.

In the embodiment shown, the downstream end 5 of the insert 4 has a diameter that is less than the diameter of the insert 4 as a whole, so as to reduce dead volume to make it as small as possible. Thus, as shown in the figures, the rigid insert 4 fills substantially all of the volume of the expulsion channel 2, leaving only a narrow passage for the fluid, and the presence of the hollow sleeve 10 at the downstream end of the expulsion channel 2 implies that the downstream end portion 5 of the insert 4 is of small diameter, in order to pass through said hollow sleeve 10.

As described above, the front wall 20 of the expulsion channel 2 can advantageously include a spray profile 21. In this case, the embodiment shown in the figures presents a major advantage in that, in the actuated position, the spray profile 21 presents an unmodified shape, since it is defined between the fixed sleeve 10 and the end wall of the expulsion channel 2. This is very different from present-day shutters made of deformable material, which are generally resiliently deformed towards their open position, so that the spray profile is necessarily modified during expulsion, which can spoil the quality of the spray. As can be clearly seen in the figures, this drawback is not reproduced by the present invention.

As also shown in the figures, the downstream end 5 of the rigid insert 4 advantageously extends beyond the hollow sleeve 10, and comes to co-operate in sealed manner with the dispenser orifice 3 in the rest position of said rigid insert 4. This embodiment ensures that the dispenser orifice 3 is itself closed. Thus, the risk of contaminating the fluid remaining inside the swirl chamber or inside the spray profile after expulsion of the dose is avoided.

Figure 3:
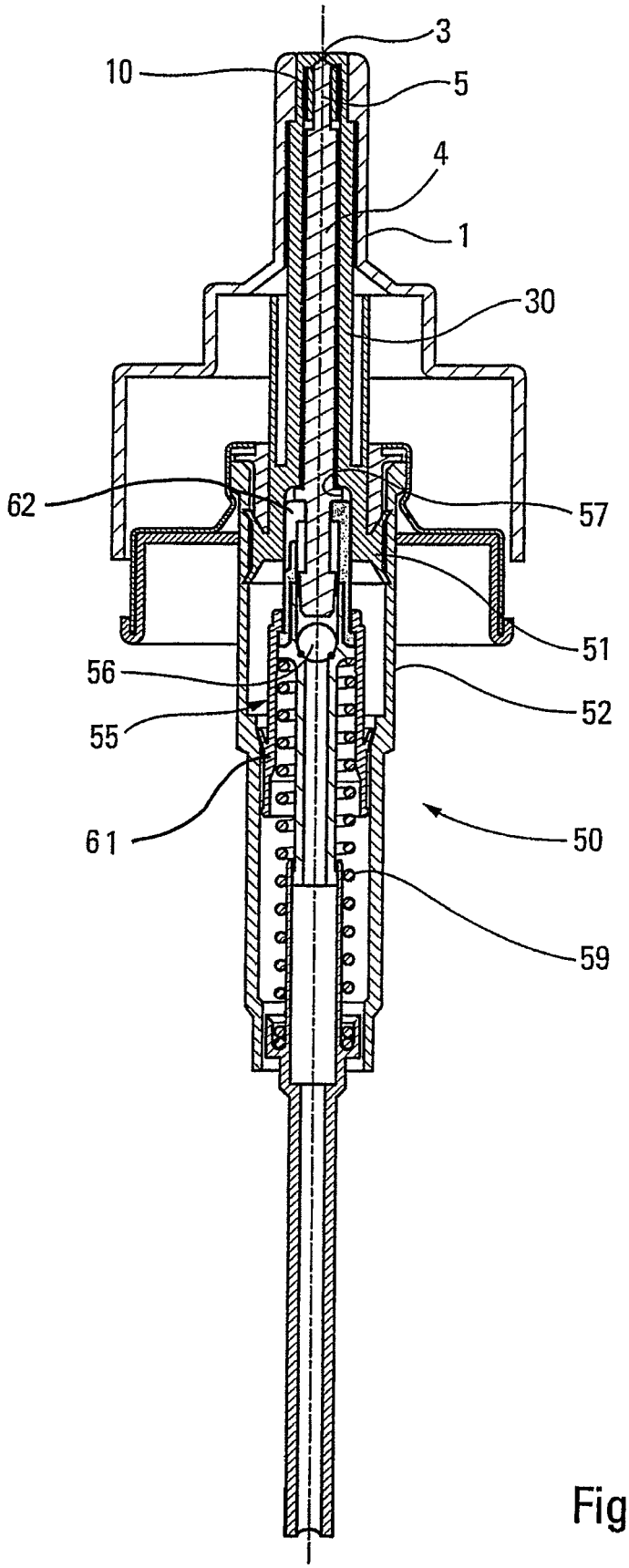
FIG. 3 is a diagrammatic cross-section view of a fluid dispenser constituting an advantageous embodiment of the invention.

The dispenser head of the present invention can be applied to any type of fluid dispenser device. FIG. 3 shows an advantageous embodiment of a dispenser including a dispenser head as described above. It comprises a reservoir (not shown) containing the fluid to be dispensed, and on which reservoir there is mounted a dispenser member, such as a pump 50, which comprises an upper piston 51 and a lower piston 61 both sliding in a pump body 52, the actuation of said pistons 51, 61 enabling the fluid contained in the reservoir to be dispensed selectively. A pump chamber 55 is defined between an inlet valve 56, which connects the pump chamber 55 to the reservoir, and an outlet valve 57, which connects the pump chamber 55 to the expulsion channel 2 of said dispenser head. The pump 50 is actuated by pushing the head 1 downwards. As the head 1 is displaced downwards, so is the upper piston 51 which increases pressure inside the pump chamber 55. The increased pressure creates a force that acts on the lower piston 61. Since the diameter of the lower piston 61 is less than the diameter of the upper piston 51, the lower piston 61 is displaced faster than the upper piston 51. While moving downwards, the lower piston 61 pulls a member 62 gripped by the top inside portion of the lower piston 61 downwards. The upper shoulder of the member 62 first slides against the rigid insert 4. At the end of the actuating stroke, the upper shoulder of the member 62 pulls the rigid insert 4 downwards, resulting in the mechanical opening of the shutter-forming rigid insert 4, and the fluid is dispensed. The rigid insert 4 is advantageously secured to said outlet valve 57 so that it is displaced from its rest position to its actuated position when the outlet valve 57 is opened, enabling the fluid to be expelled from said pump chamber 55. In particular, said rigid insert 4 itself forms the outlet valve 57 of the pump 50. The rigid insert 4 is displaced from its rest position to its actuated position at the end of the actuating strokes of the pistons 51, 61 of the pump, guaranteeing that the expulsion channel 2 and the dispenser orifice 3 are opened at the precise moment when the fluid contained in the pump chamber 55 is expelled. At the end of fluid expulsion, the outlet valve 57 is closed by the return spring 59 of the pump 50 returning the insert 4 to its rest position, i.e. the closed position of the shutter (cf. FIG. 1). The shutter is therefore opened and closed mechanically by opening and closing the outlet valve 57 of the pump 50.

The expulsion channel 2 is advantageously formed by a hollow rod 30 which is securely connected to the piston 51 of the pump, or is even formed integrally therewith, as shown in the figures. The hollow rod 30 therefore also incorporates the dispenser orifice 3. Since the hollow rod 30 cannot be removed, this embodiment foils any attempt to remove the head, which would risk contaminating the fluid. In this embodiment, the body 1 acts solely as an element for actuating the pump 50. It can be removable and can be made in any desired shape, and, in particular, it can be adapted in terms of its shape or its decoration to the fluid to be dispensed.

The present invention is described above with reference to an advantageous embodiment thereof, but naturally, various modifications can be applied thereto without going beyond the ambit of the present invention as defined by the accompanying claims.

The invention claimed is:

1. A fluid dispenser device including a dispenser head, a pump having a piston (51) for dispensing the fluid, and an outlet valve (57), said dispenser head comprising:

a body (1) defining a fluid expulsion channel (2) terminated by a dispenser orifice (3);

a rigid insert (4) disposed in said expulsion channel (2); and a shutter element (5) disposed in said expulsion channel (2);

wherein said shutter element (5) is displaceable between a closed position of the expulsion channel (2) and an open position of the expulsion channel (2);

wherein said shutter element (5) is configured to be urged at rest towards its closed position, is automatically displaced towards its open position while the fluid is dispensed, and is returned automatically to its closed position once the fluid has been dispensed;

wherein said shutter element (5) is formed integrally as a single piece with said rigid insert (4), so that said rigid insert (4) is displaceable in said expulsion channel (2) between a rest position, corresponding to the closed position of the shutter element (5), and an actuated position, corresponding to the open position of the shutter element (5);

wherein said rigid insert (4) forms, or is secured to, said outlet valve (57) of said pump (50);

wherein said rigid insert (4) is configured to be mechanically displaced towards the actuated position while the fluid is expelled and automatically returned to the rest position once the fluid has been expelled;

wherein the pressure exerted by the fluid acts indirectly on the rigid insert to displace the rigid insert, wherein said shutter element is formed by the downstream end (5) of said rigid insert (4) in the flow direction of the fluid, wherein a hollow sleeve (10) is statically disposed in said expulsion channel (2), said downstream end (5) of said rigid insert (4) sliding, preferably in sealed manner, in said sleeve (10), and a passage for the fluid being provided between the outside wall of said sleeve (10) and the inside wall of the expulsion channel (2), and wherein, in the rest position of said rigid insert (4), the downstream end (5) of said rigid insert (4) extends beyond said fixed hollow sleeve (10) and co-operates in sealed manner with said dispenser orifice (3).

2. A device according to claim 1, in which a spray profile (21) is defined between the front wall (20) of the expulsion channel (2) and said fixed hollow sleeve (10).

3. A device according to claim 1, in which said pump (50) includes a hollow rod (30) defining said expulsion channel (2), said hollow rod (30) incorporating firstly the dispenser orifice (3), and secondly the piston (51) of the pump (50).

4. A dispenser head for a fluid dispenser, the head comprising:

a body (1) defining a fluid expulsion channel (2) terminated by a dispenser orifice (3);

a rigid insert (4) being disposed in said expulsion channel (2); and a shutter element (5) disposed in said expulsion channel (2);

wherein said shutter element (5) is displaceable between a closed position of the expulsion channel (2) and an open position of the expulsion channel (2);

wherein said shutter element (5) is urged at rest towards its closed position, is automatically displaced towards its open position while the fluid is being dispensed, and is returned automatically to its closed position once the fluid has been dispensed;

wherein the pressure exerted by the fluid acts indirectly on the shutter element to displace the shutter element;

wherein said shutter element (5) is formed integrally as a single piece with said rigid insert (4), so that said rigid insert (4) is displaceable in said expulsion channel (2) between a rest position, corresponding to the closed position of the shutter element (5), and an actuated position, corresponding to the open position of the shutter element (5);

wherein said shutter element is formed by the downstream end (5) of said rigid insert (4) in the flow direction of the fluid;

wherein a hollow sleeve (10) is statically disposed in said expulsion channel (2); and wherein said downstream end (5) of said rigid insert (4) is configured to slide, preferably in sealed manner, in said sleeve (10), and a passage for the fluid is provided between the outside wall of said sleeve (10) and the inside wall of the expulsion channel (2);

wherein, while in the rest position of said rigid insert (4), the downstream end (5) of said rigid insert (4) extends beyond said fixed hollow sleeve (10) and co-operates in sealed manner with said dispenser orifice (3).

5. A dispenser head according to claim 4, in which a spray profile (21) is defined between a front upstream facing wall (20) of the expulsion channel (2) and the fixed hollow sleeve (10).

6. A device according to claim 3, in which the hollow rod, including the expulsion channel, the dispenser orifice, and the piston, is a one-piece integral construction.

7. A device according to claim 1, wherein the downstream end of the rigid insert directly contacts the dispenser orifice to close off the dispenser orifice.

8. A device according to claim 1, in which the rigid insert is displaced from the rest position to the actuated position at the end of the actuating stroke of the piston.

9. A fluid dispenser device, comprising:

a dispenser head;

a pump comprising an upper piston for dispensing the fluid; and an outlet valve;

wherein the dispenser head comprises:

a body defining a fluid expulsion channel terminated by a dispenser orifice;

a rigid insert disposed in the expulsion channel;

a shutter element disposed in the expulsion channel, the shutter element displaceable between a closed position of the expulsion channel and an open position of the expulsion channel, the shutter element urged at rest towards the closed position and automatically displaced towards the open position while the fluid is being dispensed and returning automatically to the closed position once the fluid has been dispensed, the shutter element formed integrally as a single piece with the rigid insert so that the rigid insert is pulled in the expulsion channel via a mechanical coupling from a rest position, corresponding to the closed position of the shutter element, to an actuated position to expel the fluid, corresponding to the open position of the shutter element, the rigid insert forming, or secured to, the outlet valve of the pump, the rigid insert automatically returning to the rest position once the fluid has been expelled, wherein the pump further comprises a lower piston;

wherein the pressure of the fluid created by the displacement of the first piston acts directly on the lower piston to displace the lower piston;

wherein the displacement of the lower piston mechanically displaces the rigid insert.

10. The fluid dispenser device according to claim 9, wherein the diameter of the lower piston is smaller than the diameter of the upper piston.

11. The fluid dispenser device according to claim 9, wherein the pump further comprises a member that is fixed to the lower piston and connects the lower piston to the rigid insert.

12. The fluid dispenser according to claim 11, wherein the member fixed to the lower piston comprises an upper shoulder;

wherein the upper shoulder is configured to slide along the rigid insert at the beginning of the stroke of the lower piston; and wherein the upper shoulder is configured to engage the rigid insert at the end of the stroke of the lower piston to displace the rigid insert downward to open the outlet valve.

* * * * *